US009187719B2

(12) United States Patent
Jones et al.

(10) Patent No.: US 9,187,719 B2
(45) Date of Patent: Nov. 17, 2015

(54) PROCESS FOR THE PRODUCTION OF A LIQUID COMPOSITION

(71) Applicant: The Procter & Gamble Company, Cincinnati, OH (US)

(72) Inventors: Christopher Stephen Jones, St-Gilles (BE); Vincenzo Agostiniano, Brussles (BE); Dimitri Kristof Vanspauwen, Antwerp (BE); Erwin Andre Kris Vanherle, Grimbergen (BE); Yves Lecointre, Marcelcave (FR); Sven Michielsen, Antwerp (BE); Filip Veldeman, Bornem (BE)

(73) Assignee: The Procter & Gamble Company, Cincinnati, OH (US)

( * ) Notice: Subject to any disclaimer, the term of this patent is extended or adjusted under 35 U.S.C. 154(b) by 61 days.

(21) Appl. No.: 14/102,601

(22) Filed: Dec. 11, 2013

(65) Prior Publication Data

US 2014/0179589 A1 Jun. 26, 2014

(30) Foreign Application Priority Data

Dec. 20, 2012 (EP) ..... 12198629

(51) Int. Cl.

| | |
|---|---|
| ***C11D 3/50*** | (2006.01) |
| ***C11D 17/00*** | (2006.01) |
| ***C11D 11/00*** | (2006.01) |

(52) U.S. Cl.

CPC ..... *C11D 17/0017* (2013.01); *C11D 3/50* (2013.01); *C11D 11/0094* (2013.01)

(58) Field of Classification Search

CPC ..... C11D 3/50

See application file for complete search history.

(56) References Cited

U.S. PATENT DOCUMENTS

| | | | | |
|---|---|---|---|---|
| 5,776,872 | A | 7/1998 | Giret et al. | |
| 6,376,446 | B1 * | 4/2002 | Smadi et al. | 510/325 |

FOREIGN PATENT DOCUMENTS

| | | |
|---|---|---|
| EP | 0 623 671 A1 | 11/1994 |
| WO | WO 01/77275 A1 | 10/2001 |

OTHER PUBLICATIONS

Extended European Search Report; Application No. 12198629.3-1358; dated May 23, 2013; 5 pages.

* cited by examiner

*Primary Examiner* — John Hardee

(74) *Attorney, Agent, or Firm* — John T. Dipre; Steven W. Miller

(57) ABSTRACT

A process for the production of a liquid detergent composition comprising the steps of: providing an aqueous solution free of perfumes through a main stream; providing a second solution comprising at least one perfume and at least one material selected from the group consisting of surfactants, organic solvents, carboxylic acids, and mixtures thereof, through a first side stream, wherein the ratio of said perfume to said at least one material is from 0.05 to 0.5; providing at least a third solution comprising at least one aesthetic component and/or finishing component, through at least one second side stream; and mixing the solutions to provide the liquid detergent composition. The second solution is mixed with the aqueous solution at a first confluence region of said main and first side streams and the at least third solution is mixed therewith at, at least one, second confluence region, said at least one second confluence region being downstream said first confluence region.

16 Claims, 1 Drawing Sheet

Static mixer

PROCESS FOR THE PRODUCTION OF A LIQUID COMPOSITION

FIELD OF INVENTION

The present invention relates to a method of processing materials for the production of a liquid detergent composition. Typically the liquid detergent composition is a hard surface cleaning composition, however, a person skilled in the art would understand that the process according to the present invention may be equally used for the production of other liquid detergent compositions for treating other types of surfaces such as fabric and/or personal care surfaces such as the body, skin and/or hair.

BACKGROUND OF THE INVENTION

A number of different methods and processes exist for the manufacture of liquid detergent compositions. These are typically classified in two groups: continuous processes and batch processes.

It is highly desirable, in such processes, to reduce the time lag between process steps and in particular reduce waiting time between the time a composition is fully formulated and the time such composition is bottled. Such whilst achieving quick formulation turnaround, minimizing waste material, minimizing number of storage vessels for intermediate process and finished product storage, and achieving a well dispersed composition at minimal energy and cost.

For such reasons continuous processes have become more and more desirable as they offer the potential for achieving the aforementioned desideratum. However, room for improvement still exists.

In particular, improvement in the dispersion of ingredients that are difficult to mix with aqueous components, such as perfumes, is desired. Indeed, perfumes may require a considerable amount of energy in order to be appropriately and quickly dispersed into an aqueous solution with low level of surfactants.

It has been found that the present invention is highly effective in generating a well dispersed liquid detergent composition utilizing minimal energy for its production, as well as enabling quick formulation turnaround and minimal waste material. Moreover, the present invention allows a high degree of product customization, minimizing the need of introducing dedicated storage vessels where different finished products need to be stored before bottling and packing operation.

SUMMARY OF THE INVENTION

In one aspect, the present invention relates to a process for the production of a liquid detergent composition comprising the steps of: providing an aqueous solution free of perfumes through a main stream; providing a second solution comprising at least one perfume and at least one material selected from the group consisting of surfactants, organic solvents, carboxylic acids, and mixtures thereof, through a first side stream, wherein the ratio of said perfume to said at least one material is from 0.05 to 0.5; providing at least a third solution comprising at least one aesthetic component and/or finishing component, through at least one second side stream; and mixing the solutions to provide the liquid detergent composition. Wherein, the second solution is mixed with the aqueous solution at a first confluence region of said main and first side streams and the at least third solution is mixed therewith at, at least one, second confluence region, said at least one second confluence region being downstream said first confluence region.

In another aspect, the present invention relates to the liquid detergent composition resulting from the process.

DETAILED DESCRIPTION OF THE INVENTION

Figure 1:
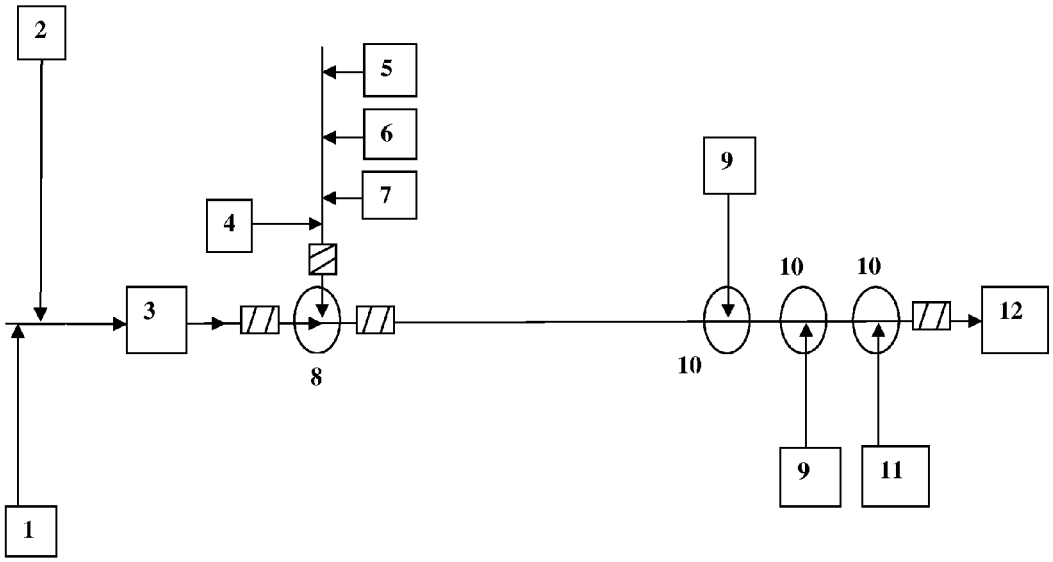
FIG. 1 is a schematic illustrating an embodiment of the process according to the invention.

As used herein the terms "a" and "an" when describing a particular element mean "at least one" of that particular element.

As used herein "continuous process" means a process wherein all steps occur continuously, typically simultaneously once steady state is reached, without a waiting and/or holding time between steps.

As used herein "in sequence" means spatial sequence i.e. the steps referred are carried out in the spatial order indicated.

As used herein "dishware" refers to a hard surface such as dishes, glasses, pots, pans, baking dishes and flatware made from ceramic, china, metal, glass, plastic (polyethylene, polypropylene, polystyrene, etc.), wood, enamel, Inox®, Teflon®, or any other material commonly used in the making of articles used for eating and/or cooking.

As used herein "hard surface" means any surface found in a household, industry and/or commercial, institutional and industrial environments such as floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox (Registered trademark, Formica (Registered trademark, any plastics, plastified wood, metal or any painted or varnished or sealed surface and the like. Hard surfaces also include household appliances including, but not limited to refrigerators, freezers, washing machines, automatic dryers, ovens, microwave ovens, dishwashers and so on. The term "hard surface" further includes also surfaces such as dishware.

As used herein "downstream" means a distal position in a direction following the flow of the liquid from the position referred.

As used herein "upstream" means a distal position in a direction against the flow of the liquid from the position referred.

Various embodiments will now be described to provide an overall understanding of the principles of the structure, function, manufacture, and use of the apparatus and methods disclosed herein. One or more examples of these embodiments are illustrated in the accompanying drawings. Those of ordinary skill in the art will understand that features described or illustrated in connection with one example embodiment can be combined with the features of other example embodiments without generalization from the present disclosure.

The Process

The invention is directed at a process, preferably a continuous process, for the production of a liquid detergent composition comprising the steps, preferably sequential, of:

(i) Providing an aqueous, preferably liquid, solution free of perfumes through a main stream;

(ii) Providing a second, preferably liquid, solution comprising, preferably consisting essentially of, more preferably consisting of, at least one perfume and at least one material selected from the group consisting of surfactants, organic solvents, carboxylic acids preferably a fatty acid, and mixtures thereof, through a first side stream, wherein the ratio of said perfume to said at least one material is from 0.05 to 0.5, preferably from 0.05 to 0.3, preferably from 0.07 to 0.25, more preferably from 0.09 to 0.2, even more preferably from 0.1 to 0.15;

(iii) Providing at least a third, preferably liquid, solution comprising at least one aesthetic component and/or finishing component, through at least one second side stream; and (iv) Mixing the solutions to provide the liquid detergent composition;

Wherein, in step (iv), the second solution is mixed with the aqueous solution at a first confluence region 8 of said main and first side streams and the at least third solution is mixed therewith at, at least one, second confluence region 10 of said main and second side streams, said at least one second confluence region 10 being downstream said first confluence region 8. Advantages of the present invention include: the possibility to disperse perfumes in short time and with low amount of energy in an aqueous solution with low level of surfactants; the possibility to allow product customization and produce a wide range of detergents formulations minimizing the numbers of storage vessels for in process intermediates and for finished products storage before bottling and packing operations; and the possibility to allow a fast changeover among different formulations produced in the process, minimizing the amount of waste generated.

FIG. 1 depicts a schematic drawing illustrating an embodiment of the aforementioned process steps which may occur in sequence. In this embodiment, the main stream follows along a substantially linear path, with side streams joining thereto to form confluence regions. It is herein understood, by a person skilled in the art, that the flow may equally follow any other path provided that the cited sequence is maintained.

As shown in FIG. 1, the second solution may be formed by mixing said at least one perfume $\mathbf{4}, \mathbf{4}_1, \mathbf{4}_2, \mathbf{4}_3, \mathbf{4}_n, \mathbf{4}_{n+1}$ and said at least one material at one or more confluence regions, preferably more than one confluence region, along said first side stream followed by mixing in a mixer, preferably a static mixer, prior to entering said first confluence region. In a preferred embodiment the perfume, the surfactants, the carboxylic acids and/or the organic solvents are mixed in the first side stream at different confluence regions located at different predetermined positions along said first side stream, namely a perfume confluence region, surfactant confluence regions, carboxylic acid confluence region and/or organic solvent confluence region respectively. In a preferred embodiment, the at least one perfume confluence region is downstream the at least one surfactant confluence region and/or the at least one carboxyllic acid and/or organic solvent confluence region, preferably the at least one surfactant confluence region is upstream the at least one perfume confluence region and the at least one carboxyllic acid and/or organic solvent confluence region is downstream the at least one perfume confluence region. Advantages of pre-mixing perfume with the above organic compounds results in even better perfume dispersion when the above mixed flow is added to the main stream at the first confluence region.

In a most preferred embodiment, the first side stream consists of one or more perfumes $\mathbf{4}, \mathbf{4}_1, \mathbf{4}_2, \mathbf{4}_3, \mathbf{4}_n, \mathbf{4}_{n+1}$ and one or more surfactants 5 preferably selected from one or more nonionic surfactants. In this embodiment it is preferred that the perfume enters the first side stream in a perfume confluence region that is downstream a surfactant confluence region, the surfactant confluence region being the region of the first side stream wherein the surfactant enters said first side stream. In this embodiment, the first stream may be further mixed, preferably by a static mixer, downstream the perfume confluence region but upstream the first confluence region 8.

Figure 2:
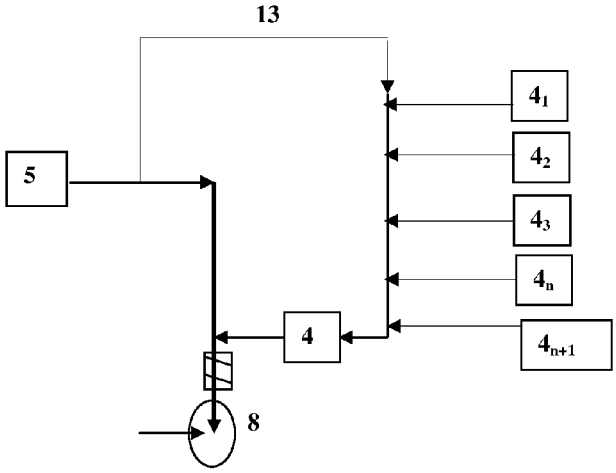
FIG. 2 is a schematic illustrating a portion of an embodiment of the process according to the invention

In one embodiment the process comprises a flush loop stream 13 in liquid communication with the surfactant stream 5, entering the first side stream at the at least one surfactant confluence region, and the perfume stream, entering the first side stream at the at least one perfume confluence region. The flush loop stream 13 may be activated once a formulation change is needed, and a different perfume needs to be used. The latter process step may be carried out following step (iv) once a predetermined amount of liquid detergent composition has been made. In this embodiment, the perfume stream 4 may be in liquid communication with a plurality of further perfume streams $\mathbf{4}_1, \mathbf{4}_2, \mathbf{4}_3, \mathbf{4}_n, \mathbf{4}_{n+1}$ converging to said perfume stream 4, as illustrated in FIG. 2. This embodiment has the advantage that the pipe(s) of the perfume stream can be easily cleaned prior to changing perfume. The latter ensures effective and quick turnaround between different formulations (having different ingredients such as perfumes) whilst at the same time not wasting excess material in the cleaning process.

In an embodiment, the main stream flows along a header pipe and the side streams flow through secondary pipes connected thereto at predefined positions. There may be further streams, such as the at least one surfactant stream, the at least one perfume stream, the at least one carboxyllic acid stream and the at least one organic solvent stream, that flow along further tertiary pipes that are connected to one or more secondary pipes at predetermined positions.

In an embodiment, the aqueous solution comprises more than one substance that have been mixed in at least one confluence region of two or more further streams prior to entering said main stream, preferably said more than one substance is selected from the group consisting of acids, alkaline materials, chelants, builders, preservatives, polymers, salts, solvents including organic solvents, carboxylic acids typically selected from citric acid, oxalic acid and/or formic acid, surfactants, thickeners, and mixtures thereof. This mixture may be defined based on the in-common ingredients of liquid detergent compositions which require differentiation only for perfumes, dyes and/or other finishing components which are added down-stream in the at least one second and in the at least one third confluence regions. Advantages of this approach is that volume to clean in case of change over to different formulation where only perfume, dyes or finishing components are different is minimized, with benefit in terms of time required and amount of waste generated.

In a preferred embodiment, the aqueous solution, the second solution and/or the at least third solution are mixed in at least one further region outside of said confluence regions 8, 10, preferably by a mixer, more preferably by a static mixer. This embodiment has the advantage of ensuring final complete mixture of the materials.

In an embodiment, the process according to the present invention comprises a further step of transferring the liquid detergent composition into a buffer mix tank 12 comprising a dynamic mixer and provide further mixing, typically homogenization, preferably said further step is following step (iv). This is particularly advantageous in order to buffer the process deviations linked to standard bias in accuracy and variability of raw materials in the continuous process as well as to buffer small deviation in overall composition achieved during transient phases of the continuous process such as start up, shut down and change-overs. In this embodiment the buffer tank may be in fluid communication with a packing line, typically via a transfer pipe, for continuous transfer of the liquid detergent composition to fill one or more, preferably a plurality of, bottles or other types of shipping containers. This provides the further advantage that the continuous making process is suitable to be coupled to bottling and/or packing process having a throughput speed which is different, preferably less, than the final flow rate of the continuous making process prior to transferring of the detergent composition into the buffer mix tank. In a preferred embodiment, one or more reblends 11 are introduced at one, or more, confluence regions being downstream the first confluence region, preferably downstream both said first confluence region and the at least one second confluence region, more preferably reblends occur prior to transferring the solutions into the buffer mix tank 12 but preferably upstream a final mixer, typically a static mixer.

Reblending acceptable amounts of finished product or intermediate liquid compositions during the making in the continuous process, allows a reduction and/or elimination of costs linked to disposal and/or scrap of these liquid compositions, which were obtained by planned or unplanned manufacturing operations, and which could either not been shipped to the market according to the internal manufacturing rules, or returning from the trade after having been shipped previously.

In another embodiment, the process comprises a final confluence region wherein one or more less compatible materials are added. Less compatible materials may be materials that are not compatible with the typical steel pipes used, thus requiring the use of other pipes such as those made of plastic or the like. A particularly preferred less compatible material is selected from bleach systems typically comprising bleach, bleach activators and/or bleach catalysts.

Surfactants

In an embodiment of the present invention the surfactants are selected from the group consisting of anionic, nonionic, cationic, zwitterionic, amphoteric, semi-polar nonionic and mixtures thereof.

In a preferred embodiment, the surfactant used in step (ii) of the process, for the generation of the second solution comprises, preferably consists of, a nonionic surfactant.

In an embodiment, the aqueous solution comprises one or more surfactants selected from the group consisting of anionic, cationic, zwitterionic, amphoteric and mixtures thereof, preferably anionic.

Suitable surfactants are those selected from the group consisting of nonionic, anionic, zwitterionic, cationic and amphoteric surfactants, having hydrophobic chains containing from 8 to 18 carbon atoms. Examples of suitable surfactants are described in McCutcheon's Vol. 1: Emulsifiers and Detergents, North American Ed., McCutcheon Division, MC Publishing Co., 2002.

Preferably, the liquid detergent composition herein comprises from 0.01% to 20% by weight of the total composition of a surfactant or a mixture thereof, more preferably from 0.5% to 10%, and most preferably from 1% to 5%.

Non-ionic surfactants are highly preferred. Non-limiting examples of suitable non-ionic surfactants include alcohol alkoxylates, alkyl polysaccharides, amine oxides, block copolymers of ethylene oxide and propylene oxide, fluoro surfactants and silicon based surfactants. Preferably, the aqueous liquid detergent compositions comprise from 0.01% to 20% by weight of the total composition of a non-ionic surfactant or a mixture thereof, more preferably from 0.5% to 10%, and most preferably from 1% to 5%.

In the most preferred embodiments, the second solution comprises one or more surfactants, preferably nonionic surfactants, in an amount of from 60% to 95%, preferably from 70% to 85%, more preferably from 75% to 80%, by weight of the second solution in the first side stream.

A preferred class of non-ionic surfactants suitable for the present invention is alkyl ethoxylates. The alkyl ethoxylates of the present invention are either linear or branched, and contain from 8 carbon atoms to 16 carbon atoms in the hydrophobic tail, and from 3 ethylene oxide units to 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from 9 to 12 carbon atoms in the hydrophobic tail, and from 4 to 9 oxide units in the hydrophilic head group. A most preferred alkyl ethoxylate is $C_{9-11}$ $EO_5$, available from the Shell Chemical Company under the tradename Neodol 91-5®. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl EO7/AO7, manufactured and sold by BASF Corporation under the tradename Lutensol XP 79/XL 79°.

Another class of non-ionic surfactant suitable for the present invention is alkyl polysaccharides. Such surfactants are disclosed in U.S. Pat. Nos. 4,565,647, 5,776,872, 5,883,062, and 5,906,973. Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from 8 to 16 carbon atoms, with an average chain length of 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000 N®, and Plantaren 2000 N UP®, from Cognis Corporation, Postfach 13 01 64, D 40551, Dusseldorf, Germany).

Another class of non-ionic surfactant suitable for the present invention is amine oxide. Amine oxides, particularly those comprising from 10 carbon atoms to 16 carbon atoms in the hydrophobic tail, are beneficial because of their strong cleaning profile and effectiveness even at levels below 0.10%. Additionally $C_{10-16}$ amine oxides, especially $C_{12}$-$C_{14}$ amine oxides are excellent solubilizers of perfume. Alternative non-ionic detergent surfactants for use herein are alkoxylated alcohols generally comprising from 8 to 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cedex, France) and under the tradename Nonidet® available from Shell Chemical.

The condensation products of ethylene oxide with a hydrophobic base formed by the condensation of propylene oxide with propylene glycol are also suitable for use herein. The hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to 40 moles of ethylene oxide. Examples of compounds of this type include certain of the commercially available Pluronic® surfactants, marketed by BASF. Chemically, such surfactants have the structure $(Ep)_x(PO)_y(Eo)_z$ or $(Po)_x(Eo)_y(Po)_z$ wherein x, y, and z are from 1 to 100, preferably 3 to 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable non-ionic surfactants include the polyethylene oxide condensates of alkyl phenols, e.g., the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived from oligomerized propylene, diisobutylene, or from other sources of iso-octane n-octane, iso-nonane or n-nonane. Other non-ionic surfactants that can be used include those derived from natural sources such as sugars and include $C_8$-$C_{16}$ N-alkyl glucose amide surfactants.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$-$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$-$C_{20}$ linear or branched, saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

An example of a $C_{14}$-$C_{16}$ alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $RiSO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like). Particularly preferred branched alkyl sulphates to be used herein are those containing from 10 to 14 total carbon atoms like Isalchem 123 AS®. Isalchem 123 AS® commercially available from Enichem is a $C_{12-13}$ surfactant which is 94% branched. This material can be described as $CH_3$—$(CH_2)_m$—$CH(CH_2OSO_3Na)$—$(CH_2)_n$—$CH_3$ where n+m=8-9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include $C_{12}$-$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted $C_6$-$C_{20}$ alkyl or hydroxyalkyl group having a $C_6$-$C_{20}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}E(1.0)SM$), $C_{12}$-$C_{18}$ alkyl polyethoxylate (2.25) sulfate ($C_{12}$-$C_{18}E(2.25)SM$), $C_{12}$-$C_{18}$ alkyl polyethoxylate (3.0) sulfate ($C_{12}$-$C_{18}E(3.0)SM$), $C_{12}$-$C_{18}$ alkyl polyethoxylate (4.0) sulfate ($C_{12}$-$C_{18}E$ (4.0)SM), wherein M is conveniently selected from sodium and potassium.

Suitable $C_6$-$C_{20}$ alkyl alkoxylated linear or branched diphenyl oxide disulphonate surfactants for use herein are according to the following formula:

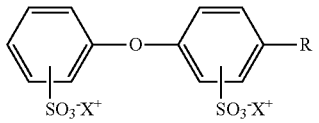

wherein R is a $C_6$-$C_{20}$ linear or branched, saturated or unsaturated alkyl group, preferably a $C_{12}$-$C_{18}$ alkyl group and more preferably a $C_{14}$-$C_{16}$ alkyl group, and X+ is H or a cation, e.g., an alkali metal cation (e.g., sodium, potassium, lithium, calcium, magnesium and the like). Particularly suitable $C_6$-

$C_{20}$ alkyl alkoxylated linear or branched diphenyl oxide disulphonate surfactants to be used herein are the $C_{12}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14}$-$C_{16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_k CH_2COO^-M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Zwitterionic surfactants represent another class of preferred surfactants within the context of the present invention.

Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082.

A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12-14}$ acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of preferred surfactants comprises the group consisting of amphoteric surfactants. One suitable amphoteric surfactant is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378.

Organic Solvents

Suitable solvents can be selected from the group consisting of: aliphatic alcohols, ethers and diethers having from 4 to 14 carbon atoms, preferably from 6 to 12 carbon atoms, and more preferably from 8 to 10 carbon atoms; glycols or alkoxylated glycols; glycol ethers; alkoxylated aromatic alcohols; aromatic alcohols; terpenes; and mixtures thereof. Aliphatic alcohols and glycol ether solvents are most preferred. Organic solvents are desired herein as they reduce the sudsing of the liquid composition. They also aid in dissolution of the perfume although to a lesser extent than surfactants.

Aliphatic alcohols, of the formula R—OH wherein R is a linear or branched, saturated or unsaturated alkyl group of from 1 to 20 carbon atoms, preferably from 2 to 15 and more preferably from 5 to 12, are suitable solvents. Suitable aliphatic alcohols are methanol, ethanol, propanol, isopropanol or mixtures thereof. Among aliphatic alcohols, ethanol and isopropanol are most preferred because of their high vapour pressure and tendency to leave no residue.

Suitable glycols to be used herein are according to the formula HO—$CR_1R_2$—OH wherein $R_1$ and R2 are independently H or a $C_2$-$C_{10}$ saturated or unsaturated aliphatic hydrocarbon chain and/or cyclic. Suitable glycols to be used herein are dodecaneglycol and/or propanediol.

In one embodiment, at least one glycol ether solvent is incorporated in the compositions of the present invention. Particularly preferred glycol ethers have a terminal $C_3$-$C_6$ hydrocarbon attached to from one to three ethylene glycol or propylene glycol moieties to provide the appropriate degree of hydrophobicity and, preferably, surface activity. Examples of commercially available solvents based on ethylene glycol chemistry include mono-ethylene glycol n-hexyl ether (Hexyl Cellosolve®) available from Dow Chemical. Examples of commercially available solvents based on propylene glycol chemistry include the di-, and tri-propylene glycol derivatives of propyl and butyl alcohol, which are available from Arco under the trade names Arcosolv® and Dowanol®.

In the context of the present invention, preferred solvents are selected from the group consisting of mono-propylene glycol mono-propyl ether, di-propylene glycol mono-propyl ether, mono-propylene glycol mono-butyl ether, di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes normal butyl, isobutyl and tertiary butyl groups. Mono-propylene glycol and mono-propylene glycol mono-butyl ether are the most preferred cleaning solvent and are available under the tradenames Dowanol DPnP® and Dowanol DPnB®. Di-propylene glycol mono-t-butyl ether is commercially available from Arco Chemical under the tradename Arcosolv PTB®.

In a particularly preferred embodiment, the cleaning solvent is purified so as to minimize impurities. Such impurities include aldehydes, dimers, trimers, oligomers and other by-products. These have been found to deleteriously affect product odour, perfume solubility and end result. The inventors have also found that common commercial solvents, which contain low levels of aldehydes, can cause irreversible and irreparable yellowing of certain surfaces. By purifying the cleaning solvents so as to minimize or eliminate such impurities, surface damage is attenuated or eliminated.

Though not preferred, terpenes can be used in the present invention. Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Suitable alkoxylated aromatic alcohols to be used herein are according to the formula R-$(A)_n$-OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Most preferred organic solvents are branched fatty alcohol, or mixtures thereof.

Suitable branched fatty alcohols to be used in the present invention are the 2-alkyl alkanols having an alkyl chain comprising from 6 to 16, preferably from 7 to 13, more preferably from 8 to 12, most preferably from 8 to 10 carbon atoms and a terminal hydroxy group, said alkyl chain being substituted in the a position (i.e., position number 2) by an alkyl chain comprising from 1 to 10, preferably from 2 to 8 and more preferably 4 to 6 carbon atoms.

Such suitable compounds are commercially available, for instance, as the Isofol® series such as Isofol® 12 (2-butyl octanol) or Isofol® 16 (2-hexyl decanol) commercially available from Condea.

Typically, the liquid composition herein may comprise up to 2% by weight of the total composition of organic solvent, typically said branched fatty alcohol, preferably from 0.10% to 1.0%, more preferably from 0.1% to 0.8% and most preferably from 0.1% to 0.5%.

The second solution may contain an organic solvent in an amount of from 0.5% to 20%, preferably from 0.8% to 10%, more preferably from 1% to 5%, by weight of the second solution in the first side stream.

Carboxylic Acid

Suitable carboxylic acids comprise fatty acids, or mixtures thereof. Fatty acids are desired herein as they reduce the sudsing of the liquid composition. They also aid in dissolution of the perfume although to a lesser extent than the surfactants taught herein.

Suitable fatty acids for use herein are the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil.

For example Coconut Fatty Acid is commercially available from UNICHEMA under the name PRIFAC 5900®.

Typically, the liquid composition herein may comprise up to 6% by weight of the total composition of said fatty acid, preferably from 0.1% to 3.0%, more preferably from 0.1% to 2.0% and most preferably from 0.15% to 1.5% by weight of the total composition of said fatty acid.

The second solution may contain a carboxylic acid, preferably a fatty acid, in an amount of from 3% to 20%, preferably from 4% to 15%, more preferably from 5% to 13%, by weight of the second solution in said first side stream.

Aesthetic Component

In an embodiment of the present invention, the aesthetic component is selected from the group consisting of dyes, beads, pearlescent agents, particles, brighteners, opacifiers and/or the like, and mixtures thereof.

Finishing Component

In an embodiment, the finishing component is selected from the group consisting of enzymes, enzyme stabilizers, bleaches, polymers, carboxylic acids, salts, exfoliating particles, carriers, chelating agents, fabric softeners, builders, dispersants, humectants, emollients, thickeners and/or the like, and mixtures thereof.

In a preferred embodiment, the finishing component comprises a thickener. In a highly preferred embodiment, the thickener is mixed at a confluence region positioned downstream of the first confluence region and at least one of the second confluence regions. One of the advantages of this embodiment is that adding the thickener later in the process ensures that the liquid detergent composition is thickened towards the end meaning that a lower energy is needed to maintain the flow through the header pipe at a substantially constant velocity.

Liquid Detergent Composition

Liquid detergent compositions resulting from the process according to the present invention are selected from the group consisting of hard surface cleaning compositions, fabric care compositions, laundry compositions, skin and body cleansing compositions, shampoos and the like, preferably hard surface cleaning compositions.

EXAMPLES

Liquid detergent compositions resulting from the process according to the present invention:

| | A | B | C | D | E | F | G | H | I |
|---|---|---|---|---|---|---|---|---|---|
| Non ionic | | | | | | | | | |
| C9/11 EO8 | 6.0 | 6.0 | 7.0 | | | 6.0 | 6.2 | 6.0 | 6.2 |
| C9/11 EO5 | | | | 3.5 | | | | | |
| C12/14 EO21 | | | | 3.5 | | | | | |
| C11 EO5 | | | | | 7.0 | | | | |

-continued

| | A | B | C | D | E | F | G | H | I |
|---|---|---|---|---|---|---|---|---|---|
| Anionic | | | | | | | | | |
| NaLAS | 2.00 | 2.25 | 1.8 | | | | 1.80 | 2.25 | 1.80 |
| NAPS | | | | 3.1 | 3.0 | 3.0 | | | |
| C12-14 AS | | | | | | | | | |
| NaCS | | | | | | | | | |
| Co surfactants | | | | | | | | | |
| C12-14 AO | 1.50 | 1.25 | 1.50 | 3.9 | 2.0 | | 1.50 | 1.25 | 1.50 |
| C12-14 Betaine | | | | | 1.0 | 3.0 | | | |
| Thickeners | | | | | | | | | |
| HM-polyacrylate | 0.76 | 0.65 | 0.75 | | | | 0.70 | 0.65 | 0.65 |
| HM-HEC | | | | 0.6 | 0.8 | | | | |
| X gum | | | | | | 0.42 | | | |
| Buffer | | | | | | | | | |
| Na2CO3 | 0.77 | 0.4 | 0.75 | 0.1 | 0.3 | 0.2 | 0.75 | 0.4 | 0.75 |
| Citric Acid | 0.046 | 0.3 | 0.3 | 0.75 | 0.75 | 0.3 | 0.3 | 0.3 | 0.30 |
| Caustic | 0.46 | 0.76 | 0.72 | 0.5 | 0.5 | 0.3 | 0.65 | 0.65 | 0.66 |
| Suds control | | | | | | | | | |
| Fatty Acid | 0.40 | 1.0 | 1.0 | 0.20 | 0.50 | 0.50 | 0.40 | 0.40 | 1.0 |
| Branched fatty alcohols | | | | | | | | | |
| Isofol 12 | | 0.2 | 0.1 | 0.2 | 0.3 | 0.5 | | | 0.1 |
| Isofol 16 | | | | | | | | | |
| Chelants | | | | | | | | | |
| DTPMP | | 0.3 | 0.30 | | | 0.2 | | | 0.3 |
| DTPA | 0.25 | | | | | | 0.25 | 0.25 | |
| GLDA | | | | | | | | | |
| Solvents | | | | | | | | | |
| IPA | | | | | | 2.0 | | | |
| n-BPPP | | | | | 2.0 | | | | |
| N-BP | | | | 4.0 | 2.0 | | | 2.0 | |
| Minors and Water | up to 100% | up to 100% | up to 100% | up to 100% | up to 100% | up to 100% | up to 100% | up to 100% | up to 100% |
| pH | 10.6 | 10.5 | 10.3 | 9.5 | 9.0 | 10.0 | 10.3 | 10.5 | 10.3 |

C9-11EO5 is a C9-11EO5 nonionic surfactant commercially available from ICI or Shell. C12,14 EO5 is a C12, 14 EO5 nonionic surfactant commercially available from Huls, A&W or Hoechst. C11 EO5 is a C11 EO5 nonionic surfactant. C12,14 EO21 is a C12-14 EO21 nonionic surfactant. NaPS is Sodium Paraffin sulphonate commercially available from Huls or Hoechst. NaLAS is Sodium Linear Alkylbenzene sulphonate commercially available from A&W. NaCS is Sodium Cumene sulphonate commercially available from A&W. Isalchem® AS is a $C_{12-13}$ sulphate surfactant commercially available from Sasol olefins and surfactants. C12-14 AO is a C12-14 amine oxide surfactant. C12-14 Betaine is a C12-14 betaine surfactant.

DMPEG is a polyethyleneglycol dimethylether. HM-HEC is a cetylhydroxethylcellulose. Isofol 12® is 2-butyl octanol commercially available from Condea. Isofol 16® is 2-hexyl decanol commercially available from Condea. n-BP is normal butoxy propanol commercially available from Dow Chemicals. IPA is isopropanol.

n-BPP is butoxy propoxy propanol available from Dow Chemicals.

The following examples illustrate the materials added at the various stages of the process.

Examples 1 to 5

A typical liquid hard surface detergent composition is made by feeding a first solution through a main stream, a second solution through a first side stream, and one or more additional solutions in one or more second side streams, according to the material balance in the following table (Examples 1 to 5). The materials are added sequentially in a ¾" pipe. The first side stream is added to the main stream at a first confluence region. In the first side stream, the perfume is added 12" downstream of the surfactant using an injection pipe. Each injection pipe is bent at a 90 angle to deliver the injected material parallel to the existing flow along the centerline of the pipe, and sized to give a material velocity within 20% of the average velocity of the existing flow. The first confluence region is followed by a 12 element Kenics KM Static mixer (available from Kenos Inc. No Andover, Me. USA) 6" after the last injection. One or more second side streams then feed into one or more second confluence regions positioned downstream the static mixer. The last of the second confluence regions is followed by a 12 element Kenics KM Static mixer (available from Kenos Inc. No Andover, Ma USA) 6" after the last injection. Total flow is 1.98 gallons/minute; velocity is 1.32 ft/sec; the average mixer shear rate is 370 $sec^{-1}$; the mix energy is 0.107 HP/gallon. The static mixer is followed by a buffer mix tank. This is a 12" diameter tank, with 9" of liquid level. The buffer mix tank contains an A310, 3" diameter, low viscosity hydrofoil agitator (available from Chemineer Inc, Dayton Ohio). Mixer energy is 0.00031 hp/gallon and yields a chemscale of 1. The mix tank continuously feeds the final container. A level controller maintains the liquid level by adjusting the outflow.

The process results in a finished detergent with the composition shown in the attached table and a viscosity of 300 mPa·s.

| Stream | Ingredient | Example 1 (wt %) | Example 2 (wt %) | Example 3 (wt %) | Example 4 (wt %) | Example 5 (wt %) |
|---|---|---|---|---|---|---|
| Main stream | Water | Balance | Balance | Balance | Balance | Balance |
| | Xanthan gum-water solution (0.5% active) | | | | 60 | |
| | Sodium Hydroxide (50% solution) | 0.92 | 1.5 | 1.3 | 0.3 | 0.2 |
| | Anionic surfactant Na-LAS | 1.9 | 1.8 | 1.8 | | |
| | DTPA (40% active solution) | 0.625 | | 1.0 | | |
| | DTPMP (25% active solution) | | 1.2 | | | 0.5 |
| | Citric Acid (50% active solution) | 0.092 | 0.6 | 0.6 | 8.4 | 0.45 |
| | Formic Acid (50% active solution) | | | | 3.2 | |
| | PVP solution (20% active) | | | | 0.125 | |
| | 1,2-Benzisothiazolin-3-one (20% active solution) | | 0.03 | | | 0.03 |
| | Sodium carbonate (30% active solution) | 2.57 | | 2.5 | | |
| | Sodium carbonate (19% active solution) | | 3.9 | | | 0.62 |
| | Magnesium Sulfate (20% active solution) | | | | | 2.5 |
| | Co-surfactant C12-14 AO | 4.69 | 4.7 | 4.7 | | |
| First side stream | Non Ionic surfactant C9/11 EO8 | 6.0 | 3.5 | 6.2 | 1.5 | 4 |
| | Non Ionic surfactant C9/11 EO5 | | 3.5 | | | |
| | Perfume | 1.05 | 0.95 | 1.1 | 0.21 | 0.4 |
| | Fatty acid | 0.40 | 1.0 | 0.4 | | 0.2 |
| | Isofol 12 | | 0.1 | | | |
| First second side stream | Dye premix | 0.1 | 0.5 | 0.5 | 0.16 | 0.5 |
| Second second side stream | Glutaraldehyde (24% active solution) | | 0.04 | 0.04 | | 0.04 |
| Third second side stream | Thickener: HM polyacrylate (30% active solution) | 2.33 | 2.25 | 2.25 | | |
| Fourth second side stream | Reblend product* | | | 2.0 | | |

*Any of Example A to I.

FIG. 1 and FIG. 2 utilize the following nomenclature: 1=Optional acid(s) 2=Optional surfactant(s) 3=Perfume free aqueous solution 4=Perfume(s) 5=Surfactant(s) 6=Optional fatty acid(s) 7=Optional organic solvent(s) 8=First confluence region 9=Solution with aesthetic component(s) and/or finishing component(s) 10=At least second confluence region(s) 11=Optional reblend 12=Buffer tank 13=Flush loop The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for the production of a liquid detergent composition comprising the steps of:

(i) providing an aqueous solution free of perfumes through a main stream;

(ii) providing a second solution comprising at least one perfume and at least one material selected from the group consisting of surfactants, organic solvents, carboxylic acids and mixtures thereof, through a first side stream, wherein the ratio of said perfume to said at least one material is from about 0.05 to about 0.5;

(iii) providing at least a third solution comprising at least one aesthetic component and/or finishing component, through at least one second side stream; and (iv) mixing the solutions to provide the liquid detergent composition;

wherein, in step (iv), the second solution is mixed with the aqueous solution at a first confluence region of said main and first side streams and the at least third solution is mixed therewith at, at least one, second confluence region, said at least one second confluence region being downstream said first confluence region, wherein said second solution is formed by mixing said at least one perfume and said at least one material at more than one confluence regions, along said first side stream followed by mixing in a mixer prior to entering said first confluence region.

2. A process according to claim 1 wherein said second solution is formed by mixing said at least one perfume and said at least one material at one or more confluence regions, along said first side stream followed by mixing in a mixer prior to entering said first confluence region.

3. A process according to claim 2 wherein said mixer consists of a static mixer.

4. A process according to claim 1 wherein the organic solvents are selected from the group consisting of aliphatic alcohols, ethers and diethers having from about 4to about 14 carbon atoms, and mixtures thereof.

5. A process according to claim 1 wherein the organic solvents comprise a 2-butyl octanol.

6. A process according to claim 1 wherein said main stream flows along a header pipe and said side streams flow through secondary pipes connected thereto at predefined positions.

7. A process according to claim 1 wherein said aqueous solution comprises more than one substance that have been mixed in at least one confluence region of two or more streams prior to entering said main stream, said more than one substance selected from the group consisting of surfactants, acids, alkaline materials, preservatives and mixtures thereof.

8. A process according to claim 1 wherein the aqueous solution, the second solution and/or the at least third solution are mixed in at least one further region outside of said confluence regions.

9. A process according to claim 1 comprising a further step of transferring the liquid detergent composition into a buffer mix tank comprising a dynamic mixer and provide further mixing.

10. A process according to claim 1 wherein one or more reblends are introduced at one, or more, confluence regions being downstream the first confluence region.

11. A process according to claim 1 wherein the aesthetic component is selected from the group consisting of dyes, beads, pearlescent agents and particles, brighteners, and mixtures thereof.

12. A process according to claim 1 wherein the finishing component is selected from the group consisting of enzymes, enzyme stabilizers, bleaches, polymers, carboxylic acids, salts, exfoliating particles, carriers, chelating agents, fabric softeners, builders, dispersants, humectants, emollients, thickeners, and mixtures thereof.

13. A process according to claim 1 wherein the finishing component comprises a thickener.

14. A process according to claim 1 wherein the process consists of a continuous process.

15. A process according to claim 1 wherein the process steps are in sequence.

16. A process for the production of a liquid detergent composition comprising the steps of:

(i) providing an aqueous solution free of perfumes through a main stream;

(ii) providing a second solution comprising at least one perfume and at least one material selected from the group consisting of surfactants, organic solvents, carboxylic acids and mixtures thereof, through a first side stream, wherein the ratio of said perfume to said at least one material is from about 0.05 to about 0.5;

(iii) providing at least a third solution comprising at least one aesthetic component and/or finishing component, through at least one second side stream; and (iv) mixing the solutions to provide the liquid detergent composition;

wherein, in step (iv), the second solution is mixed with the aqueous solution at a first confluence region of said main and first side streams and the least third solution is mixed therewith at, at least one, second confluence region, said at least one second confluence region being downstream said first confluence region, wherein the surfactants are selected from one or more nonionic surfactants.

* * * * *